US006202765B1

(12) United States Patent
Schaffer et al.

(10) Patent No.: US 6,202,765 B1
(45) Date of Patent: Mar. 20, 2001

(54) DEVICE HAVING A FILTER, A FILTER VIBRATING MEANS AND A SCRAPER USED FOR SUCKING OFF DRILLINGS

(75) Inventors: Kurt Schaffer, Seckau; Erich Brandl; Karl Schnedl, both of Grosslobming, all of (AT)

(73) Assignee: Tamrock Voest-Alpine Bergtechnik Gesellschaft m.b.H., Zeltweg (AT)

( * ) Notice: Subject to any disclaimer, the term of this patent is extended or adjusted under 35 U.S.C. 154(b) by 0 days.

(21) Appl. No.: 09/266,728

(22) Filed: Mar. 12, 1999

(30) Foreign Application Priority Data

Mar. 13, 1998 (AT) ..... 456/98

(51) Int. Cl.[7] ..... E21B 21/015

(52) U.S. Cl. ..... 175/207; 175/209; 175/213; 55/300; 55/304

(58) Field of Search ..... 175/206, 207, 175/209, 213; 55/293, 300, 304, 305, 432, 433; 210/388, 408, 396; 15/256.5

(56) References Cited

U.S. PATENT DOCUMENTS 2,453,951 * 11/1948 Vedder ..... 55/300
2,781,104 * 2/1957 Fischer ..... 55/304 X
2,975,847 * 3/1961 Feucht ..... 173/60
3,155,613 * 11/1964 Felix et al. ..... 210/232
3,792,569 * 2/1974 Carlson et al. ..... 55/300 X
3,910,360 * 10/1975 Sundstrom ..... 175/206 X
4,328,014 * 5/1982 Burgoon et al. ..... 55/300
4,708,723 * 11/1987 Howeth ..... 55/321
5,320,188 * 6/1994 England ..... 175/206

FOREIGN PATENT DOCUMENTS 63-158113 * 12/1986 (JP) .

* cited by examiner

*Primary Examiner*—Eileen D. Lillis
*Assistant Examiner*—Sunil Singh
(74) *Attorney, Agent, or Firm*—Pillsbury Winthrop LLP

(57) ABSTRACT

A device for sucking off drillings during the drilling of boreholes, comprising a suction fan (9) and a filter (10) as well as an opening closeable by a lid for emptying the drillings reception space (8) preceding the filter (10), in which, for the simple cleaning of the filter (10), the lid (12) is connected with a vibrating mechanism for the filter (10).

25 Claims, 3 Drawing Sheets

DEVICE HAVING A FILTER, A FILTER VIBRATING MEANS AND A SCRAPER USED FOR SUCKING OFF DRILLINGS

BACKGROUND OF THE INVENTION

1. Field of the Invention

A device for sucking off drillings during the drilling of boreholes, comprising a suction fan and a filter as well as an opening closeable by a lid for emptying the drillings reception space preceding the filter.

2. Prior Art

When drilling boreholes for the purpose of setting roof bolts in order to stabilize the rock it is known to scour the drillings forming either by aid of liquids, such as water, under pressure or to effect removal via suction by hauling the drillings through the drill rod without scouring agent so as to get them into a suction device via a suction channel. Known suction devices of that type comprise a drillings reception chamber or reception space, into which the suction channel opens. To that reception space is connected a suction fan with a filter being interposed. The purified air, as a rule, is blown out in the direction towards the mine face. After termination of the drilling phase, both the driving motor and the suction fan may be set out of operation, wherein the drillings collected in the reception space may be discharged by opening the lid. In doing so, the drillings usually get on the floor.

Those known suction fan arrangements involve the drawback that thorough cleaning of the collection vessel in most cases is feasible only to an insufficient degree and that, above all, the filters are not cleaned. With the filters being rendered more and more impure, the suction performance will decrease, which might affect the performance of the drilling device.

SUMMARY OF THE INVENTION

The invention aims at providing a device of the initially defined kind by which it is feasible in a simple manner to effectively clean the filter of the suction device, thereby avoiding a decrease of the suction performance. Furthermore, the invention aims to further develop a device of the initially defined kind so as to enable enhanced clearance and enhanced discharging of the drillings from the reception space or reception chamber.

To solve this object, the invention, departing from a device of the initially defined kind, essentially consists in that the lid is connected with a filter vibrating means. Such a vibrating means may be of a relatively simple configuration, it merely being required to appropriately couple the vibrating means with the lid and, in particular, with the pivotal movement of the lid. Thus, after having stopped the suction motor and opened the lid, vibration and hence cleaning of the filter are effected simultaneously, wherein the material thrown off the filter surfaces by vibration can be discharged through the closeable opening opened via the lid.

In a particularly simple manner, the configuration according to the invention is devised such that the lid is designed as a bottom flap and to the lid is hinged a vibrating rod or ratchet which cooperates with a ratchet or vibrating rod engaging at the filter. Such a simple mechanical device in which, for instance, a toothed rack may be connected with the lid as the vibrating rod at every opening of the bottom flap will cause a vibrating movement of the filter as a function of the engagement of the ratchet in the vibrating rod, thereby throwing off material adhering to the filter surfaces.

In order to be able to reliably exert said vibrating movement on any standard filters without modification of the filters, the configuration advantageously is devised such that a comb-like engagement part for the pockets of a pocket filter is connected with at least one spring band reaching into the reception space and that the spring band carries at least one projection or conical pin cooperating with a vibrating rod formed by a toothed rack, and that the vibrating rod is articulately hinged to the pivotable lid. Such a comb-like configuration of the engagement part may be brought into engagement with standard pocket filters as are common in suction devices and, in this manner, the vibrating movement is safely transmitted onto the filter without requiring modifications at the filter itself. The vibrating movement is imparted by means of a spring band each in ratched-like engagement with a vibrating rod or toothed rack, said vibrating movement being induced by the projections reaching into the teeth of the toothed rack or vibrating rod and causing the spring band to be bent and the bent spring band to accordingly snap back upon entry into the consecutive tooth space.

In order to ensure simple coupling of the vibrating rod with the lid, the configuration advantageously is devised such that the vibrating rod is hinged to the lid at a distance from the pivot axis of the lid and is pivotably guided within the reception space.

In order to further enhance the discharging of drillings from the reception chamber or reception space and be able to safely remove deposits from the walls of the reception space, the configuration advantageously is devised such that at least one scraper is connected with the lid for scraping material off bottoms or side walls of the reception space, particularly during closing of the lid. The scraper may be designed in the manner of a rake and may be pressed, in particular resiliently, against the wall of the reception space and, in particular, a bottom wall of the same.

According to a preferred further development of the device according to the invention, the scraper itself is articulately connected with the pivotable lid so as to be able to follow, in particular inclinedly arranged, side walls of the reception space while maintaining a scraping contact during opening of the lid.

Fixation of the comb-like reception part for the pocket filter advantageously is realized in a manner that the comb-like engagement part via at least one spring band is fixed to a housing including a guide part for the vibrating rod.

An appropriate negative pressure prevails within the reception space during the suction operation, and in order to be able to ensure safe sucking off the lid must be closed in an accordingly tight manner during the suction operation. In order to enable the opening of the lid and hence the discharging of the drillings, the configuration advantageously is devised such that the lid is connected with a pivot drive capable of being locked in its closing position with the fan motor running.

BRIEF DESCRIPTION OF THE DRAWINGS

In the following, the invention will be explained in more detail by way of an exemplary embodiment schematically illustrated in the drawing. Therein.

DETAILED DESCRIPTION OF A PREFERRED EMBODIMENT OF THE INVENTION

Figure 1:
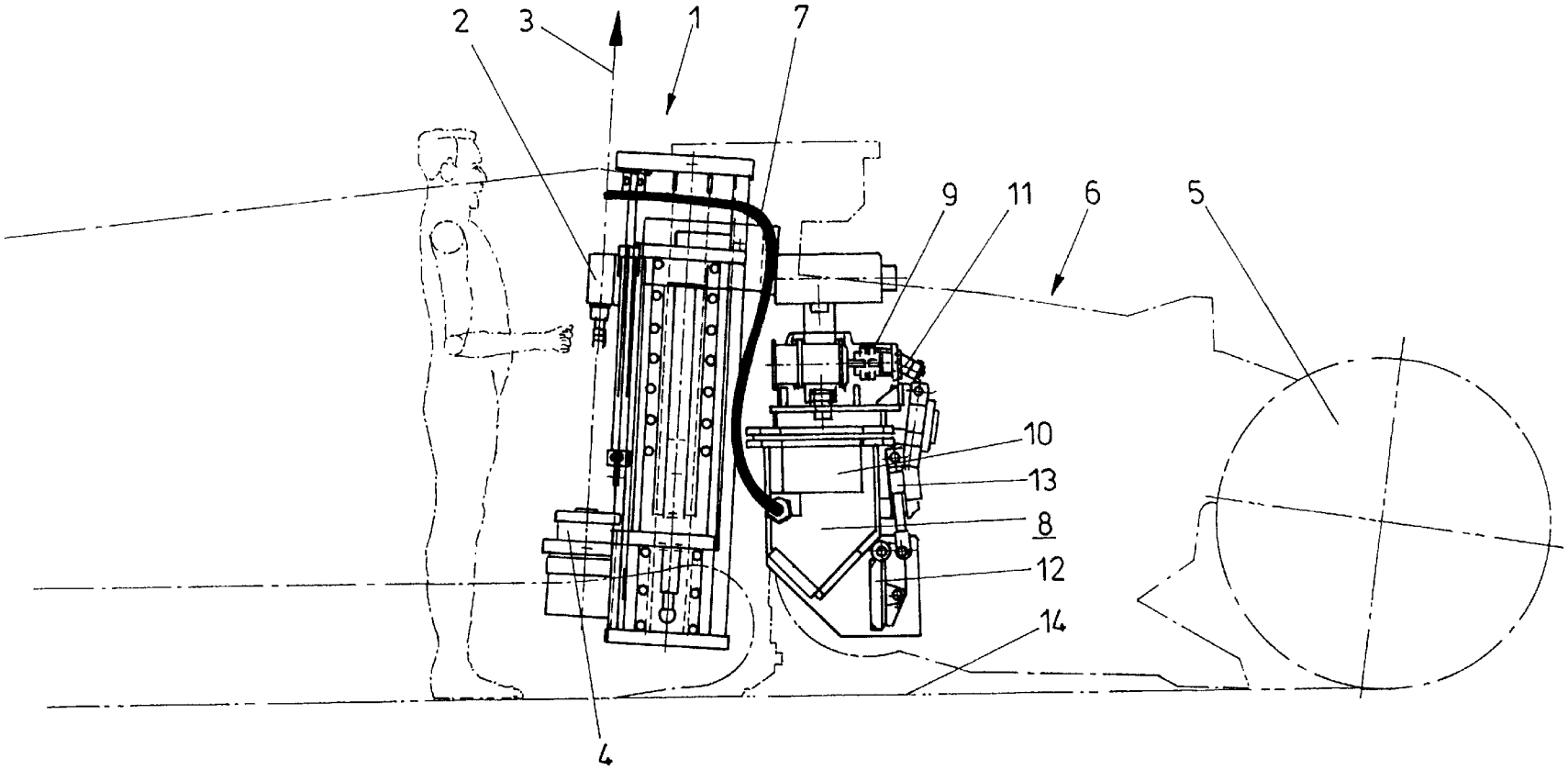
FIG. 1 is a partially sectioned schematic side view of a conventional roof bolt drilling and setting device.

In FIG. 1, a roof bolt drilling and setting device is denoted by 1. After insertion of a drill rod in the respective bearing spaces 2, the drill rod can be displaced towards the roof in the direction of arrow 3, the drilling motor being schematically indicated by 4. In the side view, the cutting head 5 of a cutting means 6 is schematically apparent, wherein the roof bolt drilling and setting device usually is to set roof bolts near the mine face that is being operated by the cutting tools or cutting head 5.

With the roof bolt drilling and setting device 1, the drillings are sucked into a suction space 8 constituting the reception space, via a suction hose 7. The drilling fan is schematically indicated by the motor 9, a filter 10 being interposed between the suction space 8 and the suction fan 9. The filtered and purified air is blown out in the direction towards the mine face via an outlet opening 11. The suction space 8 or reception space comprises a pivotable lid 12 whose pivot drive is denoted by 13. By opening the pivotable lid 12, the drillings collected in the reception space 8 get on the floor 14 and are discharged in that manner.

Figure 2:
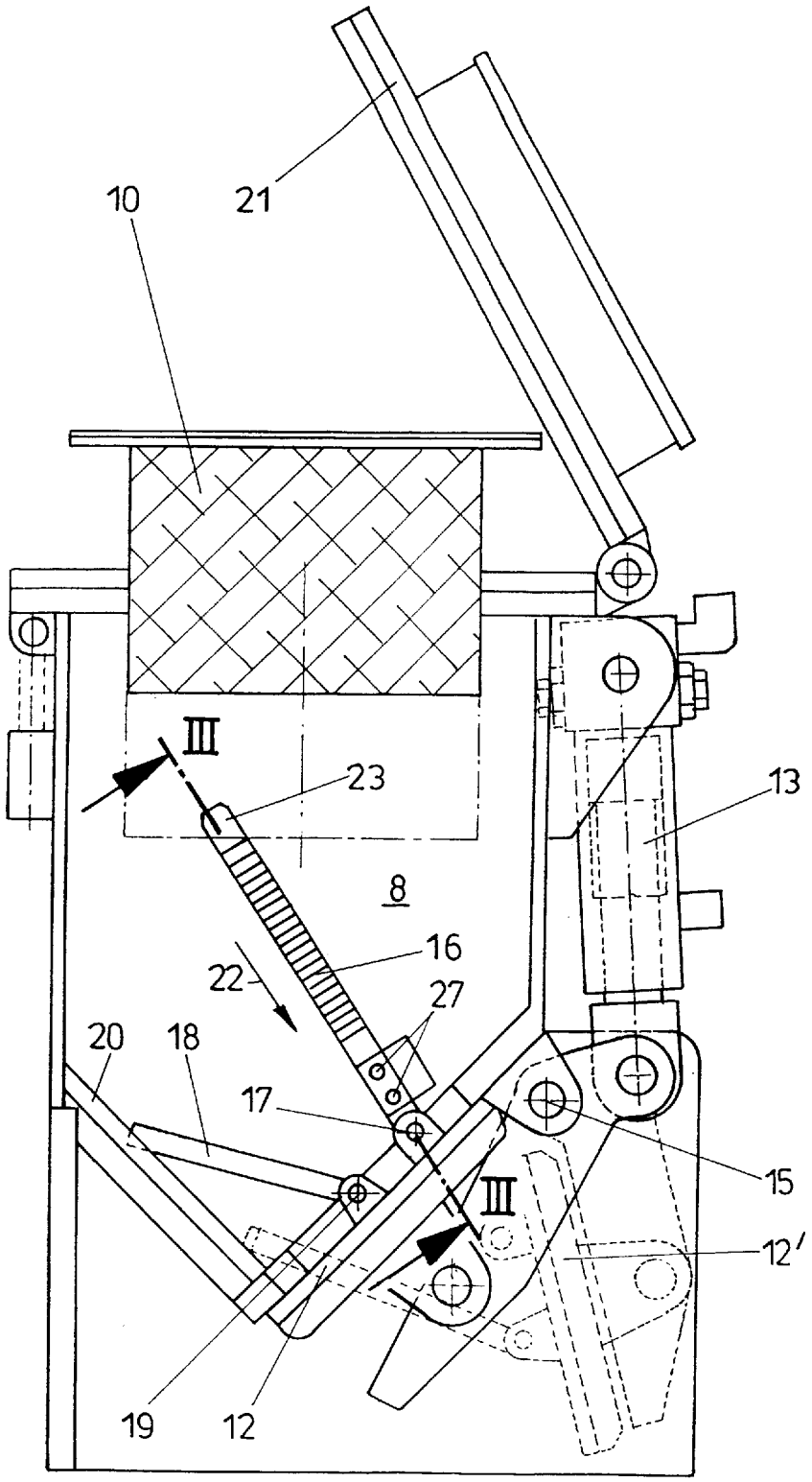
FIG. 2 is an enlarged illustration of the suction chamber or reception space of a configuration according to the invention.

In the configuration according to the invention as represented in FIG. 2, the lid 12 is illustrated in the closed position and may be pivoted into the broken-line position 12' by the pivot drive 13. The pivot drive 13 is designed as a hydraulic cylinder piston unit engaging at a bearing eye of the lid, the lid 12 during opening being pivoted into position 12' about the pivot axis 15.

A toothed rack 16 is hinged to the lid via an articulation 17. Furthermore, a scraper 18 is hinged to the lid so as to be pivotable about an axis 19, wherein the axis 19 may be connected with a spring maintaining the scraper 18 each in contact with the side wall 20 of the reception or suction space 8.

The filter 10 is designed as a removable pocket filter capable of being changed upon folding off of the upper housing part 21, to which the suction fan is connected.

Pivoting of the lid 12 into the position 12' causes the vibrating rod to be displaced in the sense of arrow 22. During that displacement of the vibrating rod in the sense of arrow 22 as well as during the displacement back during closing of the lid 12 opposite to the direction of arrow 22, a vibrating movement is exerted on the filter 10 as will be elucidated by way of FIG. 3.

Figure 3:
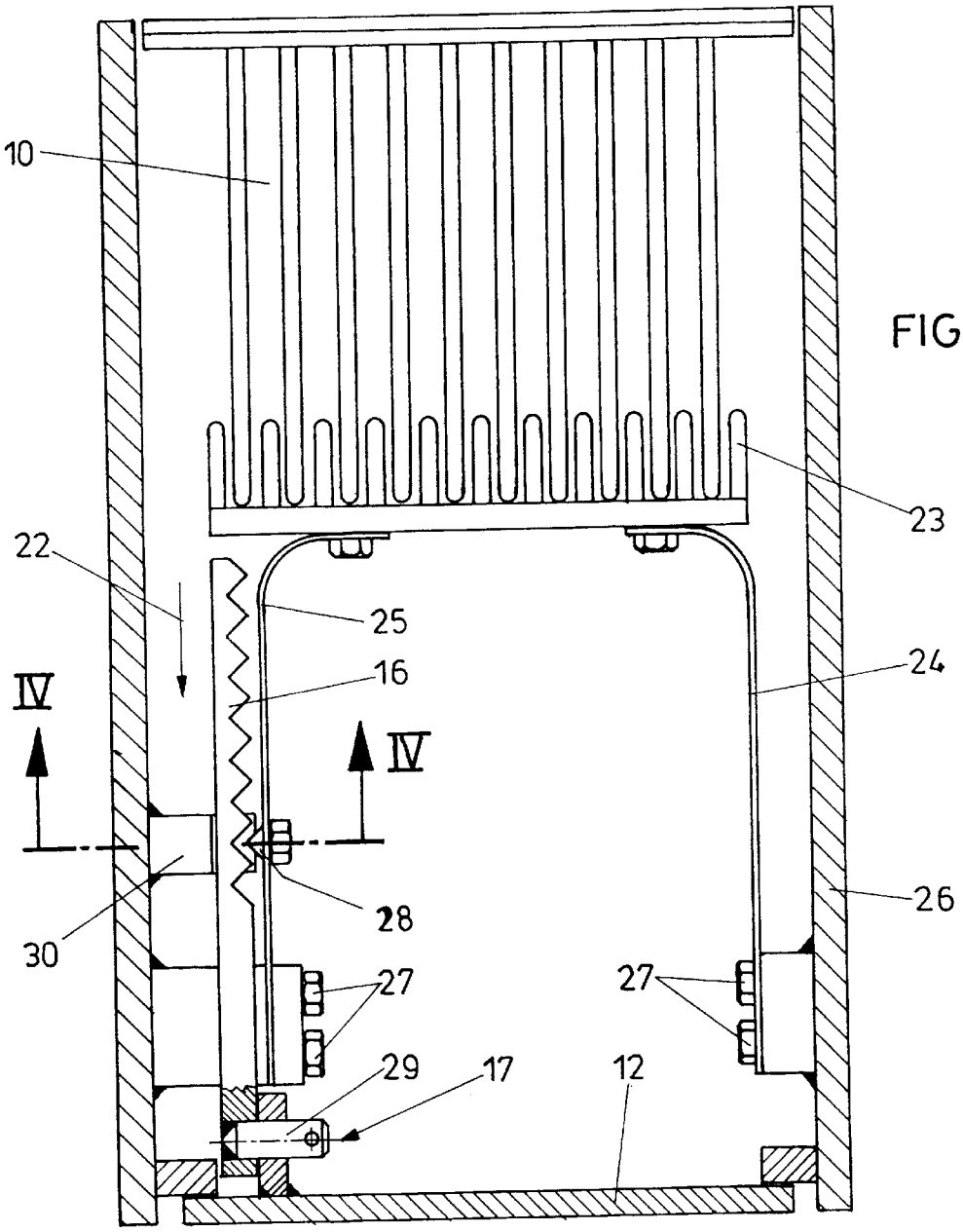
FIG. 3 is a section along line III—III of FIG. 2.

From FIG. 3 the vibrating rod 16 designed as a toothed rack is apparent. The filter 10 is designed as a pocket filter, meshing by means of a comb-like engagement part 23 which, in turn, is fixed to the housing 26 of the reception space 8 via spring bands 24 and 25. Screws 27 serve fixation.

At least one of these spring bands carries a conical projection 28 meshing with the toothed rack 16. By pivoting the lid 12, the pin 29 of the articulation 17 entrains the toothed rack 16 in the sense of arrow 22, thus causing the projection 28 to jump from one of the tooth spaces to the consecutive tooth space while bending the resilient band 25. By such a bending of the spring band 25 and the subsequent immersion into the consecutive tooth space of the toothed rack 16, a vibrating movement is exerted on the comb-like engagement part 23 and hence on the filter 10 such that material adhering to the external side of the filter 10 gets towards the lid, which allows discharging of the material in its opened position.

In regard to the pivotal movement of the toothed rack 16 during pivoting of the lid 12, an appropriate guide with play must be provided, the guide part for the toothed rack being denoted by 30 in FIG. 3.

Figure 4:
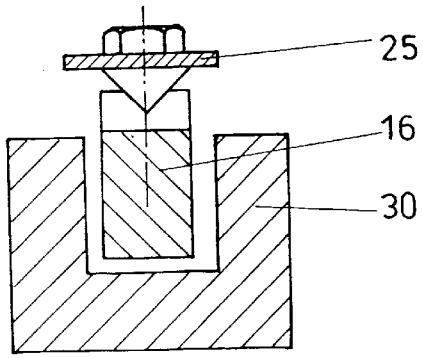
FIG. 4 is a section along line IV—IV of FIG. 3.

In FIG. 4, this guide part 30 is illustrated on an enlarged scale. The guide part 30 embraces the toothed rack 16 with play such that slight lateral pivotal movements can be taken into account.

Each opening of the bottom flap 12 as well as its subsequent closing, thus, causes a vibration of the filter with the respective cleaning of the bottom surface by the scraper 18 being effected at the same time. In doing so, a particular advantage of the configuration according to the invention consists in that it may be readily installed in existing devices and no separate actuating means are required for the vibrating movement, since the vibrating comb is directly coupled with the pivotal movement of the bottom flap.

What is claimed is:

1. A device for sucking off drillings into a reception space of a housing during the drilling of boreholes, said device comprising:

a fan and a filter mounted within said housing, said fan being operative to move air from the reception space through the filter for discharge from the housing;

a lid movable between closed and open positions relative to an opening in the reception space, said lid permitting emptying of drillings from the reception space through said opening when the lid is in the open position;

a rod connected to said lid so as to be displaced when said lid is moved between closed and open positions; and means engaging said rod and joined to the filter to impart vibrational movement to the filter in response to relative movement between the rod and the rod-engaging means when said rod is displaced, one of the rod and the rod-engaging means including a ratchet located where the rod-engaging means engages the rod.

2. A device according to claim 1, wherein said ratchet is formed on the rod and wherein said rod-engaging means comprises: a comb-like engagement part which extends within pockets formed in the filter; at least one spring band joined to the engagement part and extending into the reception space; and at least one projection extending from the at least one spring band to engage the ratchet formed on the rod, said rod being articulately hinged the to the lid.

3. A device according to claim 1 or 2, wherein said lid is pivotally movable about a pivot axis and the rod is hinged to the lid at a distance from the pivot axis, said rod being guided within the reception space when the lid is pivotally moved between closed and open positions.

4. A device according to claim 1 or 2, further comprising a scraper connected to said lid and contacting a wall of the housing within the reception area for scraping material from the wall during closing of the lid.

5. A device according to claim 3, further comprising a scraper connected to said lid and contacting a wall of the housing within the reception area for scraping material from the wall during closing of the lid.

6. A device according to claim 4, wherein said scraper is articulately connected with the lid and wherein said wall contacted by the scraper is inclined with respect to said opening in the reception space.

7. A device according to claim 5, wherein said scraper is articulately connected with the lid and wherein said wall contacted by the scraper is inclined with respect to said opening in the reception space.

8. A device according to claim 2, wherein said at least one spring band is connected to the housing, and wherein the device further comprises a guide part located within the reception space for guiding the rod.

9. A device according to claim 3, wherein said at least one spring band is connected to the housing, and wherein the device further comprises a guide part located within the reception space for guiding the rod.

10. A device according to claim 4, wherein said at least one spring band is connected to the housing, and wherein the device further comprises a guide part located within the reception space for guiding the rod.

11. A device according to claim 5, wherein said at least one spring band is connected to the housing, and wherein the device further comprises a guide part located within the reception space for guiding the rod.

12. A device according to claim 6, wherein said at least one spring band is connected to the housing, and wherein the device further comprises a guide part located within the reception space for guiding the rod.

13. A device according to claim 7, wherein said at least one spring band is connected to the housing, and wherein the device further comprises a guide part located within the reception space for guiding the rod.

14. A device according to claim 1 or 2, wherein the lid is connected with a pivot drive for opening and closing the lid, said pivot drive being capable of locking the lid in a closed position with the fan running.

15. A device according to claim 3, wherein the lid is connected with a pivot drive for opening and closing the lid, said pivot drive being capable of locking the lid in a closed position with the fan running.

16. A device according to claim 4, wherein the lid is connected with a pivot drive for opening and closing the lid, said pivot drive being capable of locking the lid in a closed position with the fan running.

17. A device according to claim 5, wherein the lid is connected with a pivot drive for opening and closing the lid, said pivot drive being capable of locking the lid in a closed position with the fan running.

18. A device according to claim 6, wherein the lid is connected with a pivot drive for opening and closing the lid, said pivot drive being capable of locking the lid in a closed position with the fan running.

19. A device according to claim 7, wherein the lid is connected with a pivot drive for opening and closing the lid, said pivot drive being capable of locking the lid in a closed position with the fan running.

20. A device according to claim 8, wherein the lid is connected with a pivot drive for opening and closing the lid, said pivot drive being capable of locking the lid in a closed position with the fan running.

21. A device according to claim 9, wherein the lid is connected with a pivot drive for opening and closing the lid, said pivot drive being capable of locking the lid in a closed position with the fan running.

22. A device according to claim 10, wherein the lid is connected with a pivot drive for opening and closing the lid, said pivot drive being capable of locking the lid in a closed position with the fan running.

23. A device according to claim 11, wherein the lid is connected with a pivot drive for opening and closing the lid, said pivot drive being capable of locking the lid in a closed position with the fan running.

24. A device according to claim 12, wherein the lid is connected with a pivot drive for opening and closing the lid, said pivot drive being capable of locking the lid in a closed position with the fan running.

25. A device according to claim 13, wherein the lid is connected with a pivot drive for opening and closing the lid, said pivot drive being capable of locking the lid in a closed position with the fan running.

* * * * *